US005888619A

United States Patent [19]

Griffin

[11] Patent Number: 5,888,619

[45] Date of Patent: Mar. 30, 1999

[54] ELEMENTS FACED WITH SUPERHARD MATERIAL

[75] Inventor: Nigel D. Griffin, Whitminster, England

[73] Assignee: Camco Drilling Group Ltd., Stonehouse, Gloucestershire, England

[21] Appl. No.: 716,586

[22] Filed: Sep. 18, 1996

[30] Foreign Application Priority Data

Sep. 23, 1995 [GB] United Kingdom ..... 9519484
Aug. 21, 1996 [GB] United Kingdom ..... 9617520

[51] Int. Cl.[6] ..... B32B 3/00

[52] U.S. Cl. ..... 428/172; 428/133; 428/137; 428/161; 428/192; 428/212; 428/542.8

[58] Field of Search ..... 428/192, 172, 428/167, 542.8, 137, 133, 161, 120, 212

[56] References Cited

U.S. PATENT DOCUMENTS 5,534,329 7/1996 Bunimovich et al. ..... 428/192

FOREIGN PATENT DOCUMENTS 0691167 1/1996 European Pat. Off. .
2275068 8/1994 United Kingdom .
2283772 5/1995 United Kingdom .
2283773 5/1995 United Kingdom .
2290325 12/1995 United Kingdom .
2290326 12/1995 United Kingdom .
2290327 12/1995 United Kingdom .
2290328 12/1995 United Kingdom .

*Primary Examiner*—Donald Loney

[57] ABSTRACT

A preform element includes a polycrystalline facing table having a front face, a peripheral surface, and a rear surface bonded to the front surface of a tungsten carbide substrate. The front surface of the substrate has a flat central region and an outer peripheral region which is inclined away from the front face of the facing table as it extends outwardly. The outer peripheral region is formed with a number of spaced semi-circular recesses into which extend projections of diamond material formed on the rear surface of the facing table. The outer edge of each recess lies on the periphery of the substrate and the curved inner edge is tangential to the central region of the substrate. Smaller recesses are formed in the bottom surfaces of the semi-circular recesses and at other locations over the front surface of the substrate.

32 Claims, 3 Drawing Sheets

ELEMENTS FACED WITH SUPERHARD MATERIAL

BACKGROUND OF THE INVENTION

1. Field of the Invention

The invention relates to elements faced with superhard material, and particularly to preform cutting elements comprising a facing table of superhard material having a front face, a peripheral surface, and a rear surface bonded to a substrate of material which is less hard than the superhard material.

2. Description of Related Art

Preform elements of this kind are often used as cutting elements on rotary drag-type drill bits, and the present invention will be particularly described in relation to such use. However, the invention is not restricted to cutting elements for this particular use, and may relate to preform cutting elements for other purposes. For example, elements faced with superhard material, of the kind referred to, may also be employed in workpiece-shaping tools.

Preform elements used as cutting elements in rotary drill bits usually have a facing table of polycrystalline diamond, although other superhard materials are available, such as cubic boron nitride and amorphous diamond-like carbon (ADLC). The substrate of less hard material is often formed from cemented tungsten carbide, and the facing table and substrate are bonded together during formation of the element in a high pressure, high temperature forming press. This forming process is well known and will not be described in detail.

Each preform cutting element may be mounted on a carrier in the form of a generally cylindrical stud or post received in a socket in the body of the drill bit. The carrier is often formed from cemented tungsten carbide, the surface of the substrate being brazed to a surface on the carrier, for example by a process known as "LS bonding". Alternatively, the substrate itself may be of sufficient thickness as to provide, in effect, a cylindrical stud which is sufficiently long to be directly received in a socket in the bit body, without being brazed to a carrier. The bit body itself may be machined from metal, usually steel, or may be moulded using a powder metallurgy process.

Such cutting elements are subjected to extremes of temperature during formation and mounting on the bit body, and are also subjected to high temperatures and heavy loads when the drill is in use down a borehole. It is found that as a result of such conditions spalling and delamination of the superhard facing table can occur, that is to say the separation and loss of the diamond or other superhard material over the cutting surface of the table.

This may also occur in preform elements used for other purposes, and particularly where the elements are subjected to repetitive percussive loads, as in tappets and cam mechanisms.

Commonly, in preform elements of the above type, the interface between the superhard table and the substrate has usually been flat and planar. However, particularly in cutting elements for drill bits, attempts have been made to improve the bond between the superhard facing table and the substrate by configuring the rear face of the facing table and the front face of the substrate so as to provide a degree of mechanical interlocking between them.

It is also desirable, in preform elements of the above type, to provide increased thickness of the superhard facing table at its periphery to provide additional strength in that region which, in a cutting element for a rotary drill bit, provides the cutting edge of the element. Normally this has been achieved by forming a continuous peripheral ring of greater thickness and constant depth around the outer periphery of the rear surface of the facing table. In known arrangements it is often necessary or desirable for the projections on the rear surface of the facing table to be of greater depth than the peripheral ring, in order to provide adequate mechanical interlocking with the substrate.

Various configurations of the interface between the superhard facing table and substrate in a preform element are described in British Patent Applications Nos. 2283773, 9512173.7, 9512174.5, 9512177.8 and 9512175.2.

While some of these existing designs can provide advantages, it may sometimes be found that the projections on the rear surface of the facing table require to project into the substrate to a considerable depth in order to provide an adequate locking function. For example, in some types of preform element the thickness of the substrate may be less than 3mm, and if the projections on the facing table are extended into the substrate to provide adequate interlocking between the facing table and substrate they may have the undesirable effect of weakening the structure of the substrate. This difficulty might, of course, be overcome by increasing the thickness of the substrate, but not only may thicker preforms be more difficult and costly to manufacture, but difficulties are also likely to arise due to existing manufacturing processes and designs of drill bit already being geared to preforms of the standard thickness.

The present invention sets out to provide a design of preform element where the configuration of the projections on the rear surface of the facing table is such that they provide good interlocking between the facing table and substrate with comparatively small depth of the projections to the rear of the facing table.

Preform elements of the kind to which the present invention relates are usually manufactured by first pre-forming a shaped solid substrate from suitable material, such as tungsten carbide, and then applying to one surface of the substrate a layer of diamond or other superhard particles. The superhard layer then automatically conforms to the shape of the substrate surface, the particles filling any recesses which have been pre-formed in that surface. When the substrate and superhard layer are bonded together in the high pressure, high temperature forming press, the diamond particles bond together and to the substrate, and the rear surface of the superhard facing table becomes integrally formed with projections of superhard material which extend into the recesses in the substrate.

As previously explained, certain characteristics of the finished preform element may depend on the shape and configuration of these superhard projections. However, since the projections are usually, in practice, moulded according to the shape of the pre-formed substrate, it is convenient to define a desired configuration of superhard projections in terms of the shape of the substrate which is required to produce them, and the present invention will therefore be defined in such terms.

SUMMARY OF THE INVENTION

According to the invention there is provided a preform element including a facing table of superhard material having a front face, a peripheral surface, and a rear surface bonded to the front surface of a substrate which is less hard than the superhard material, the front surface of the substrate being formed around its periphery with a plurality of spaced recesses into which extend projections of superhard material integrally formed on the rear surface of the facing table, each recess having an outer edge which lies adjacent the periphery of the substrate, and the maximum length of each recess, along a radius of the substrate, being no greater than twice the maximum width of the recess in the peripheral direction..

In this arrangement according to the invention, since the outer edges of the recesses in the substrate lie adjacent the periphery of the facing table, the superhard projections which fill the recesses also lie adjacent the periphery. This therefore provides the desirable additional strength to the facing table around its periphery and has a similar effect to the provision of a continuous peripheral ring as in the prior art arrangements. However, since the reinforcing projections are spaced apart around the periphery of the facing table, the material of the substrate extends laterally between the spaced projections and this, together with the shape and size of the projections, provides a good mechanical interlock. The depth of the projections need be no more than the depth of the peripheral ring in the prior art arrangements. However, since the projections, unlike the continuous peripheral ring, also provide a mechanical interlock between the facing table and substrate it may no longer be necessary, in order to provide an adequate interlock, to form the rear surface of the facing table with projections which extend to a greater depth into the substrate.

Thus the present arrangement can provide increased peripheral strength plus mechanical interlocking in a depth of the projections which may be no greater than the depth of the peripheral ring of the prior art. This therefore avoids any possible weakening of the substrate which may result from the deeper projections of the prior art, and also avoids the manufacturing problems which would result from use of a thicker substrate, as mentioned above.

The outer edge of each recess may form part of the outer periphery of the substrate.

The recesses according to the invention are non-elongate, and preferably the maximum length of each recess is no greater than 1.5 times its maximum width in the peripheral direction. More preferably the maximum length of each recess is less than its maximum width in the peripheral direction.

Said inner edge of each recess, or the major part thereof, may be curved, for example it may be part-circular or substantially semi-circular. In the case where the whole of the inner edge of the recess is semi-circular the maximum length of the recess will be substantially half its width at the periphery.

Each recess may have a bottom surface which is substantially flat and substantially parallel to the front face of the facing table.

The recesses may all be of similar maximum depth, and the maximum depth of each recess may be similar to the thickness of the rest of the facing table. Preferably the maximum thickness of the facing table, including the projections which extend into said recesses in the substrate, is less than half the overall thickness of the preform element.

The recesses are preferably substantially equally spaced around the periphery of the substrate, and they may be the only recesses formed on the front surface of the substrate.

In any of the above arrangements the front surface of the substrate may have a central region and an outer peripheral region which is generally inclined away from the front face of the facing table as it extends outwardly, said recesses being formed in the inclined outer peripheral region of the substrate.

In this case each recess may increase in depth as it extends inwardly towards the central region of the substrate. For example, each recess may be of substantially zero depth at its outer extremity. The inner extremity of each recess may lie adjacent the central region of the substrate.

The central region of the front surface of the substrate may be substantially flat and parallel to the front face of the superhard facing table.

The central region and/or the outer peripheral region of the front surface of the substrate may also be formed with a plurality of spaced subsidiary recesses into which extend protrusions of superhard material integrally formed on the rear surface of the facing table. The bottom surfaces of the first said recesses may also be formed with a plurality of spaced subsidiary recesses into which extend protrusions of superhard material integrally formed on the rear surface of the facing table. Preferably, at least some of the subsidiary recesses intersect the outer periphery of the substrate, so that the protrusion of superhard material extending into the recess is partly exposed at the outer periphery of the preform element.

The subsidiary recesses may be circular in cross-section. The depth of the subsidiary recesses may vary irregularly or randomly across the surface of the substrate.

The subsidiary recesses may be arranged in a regular pattern across the surface of the substrate or may be spaced irregularly or randomly apart across the substrate.

In any of the arrangements according to the invention the element may be circular in configuration and of substantially constant thickness.

DETAILED DESCRIPTION OF THE PREFERRED EMBODIMENTS

Figure 1:
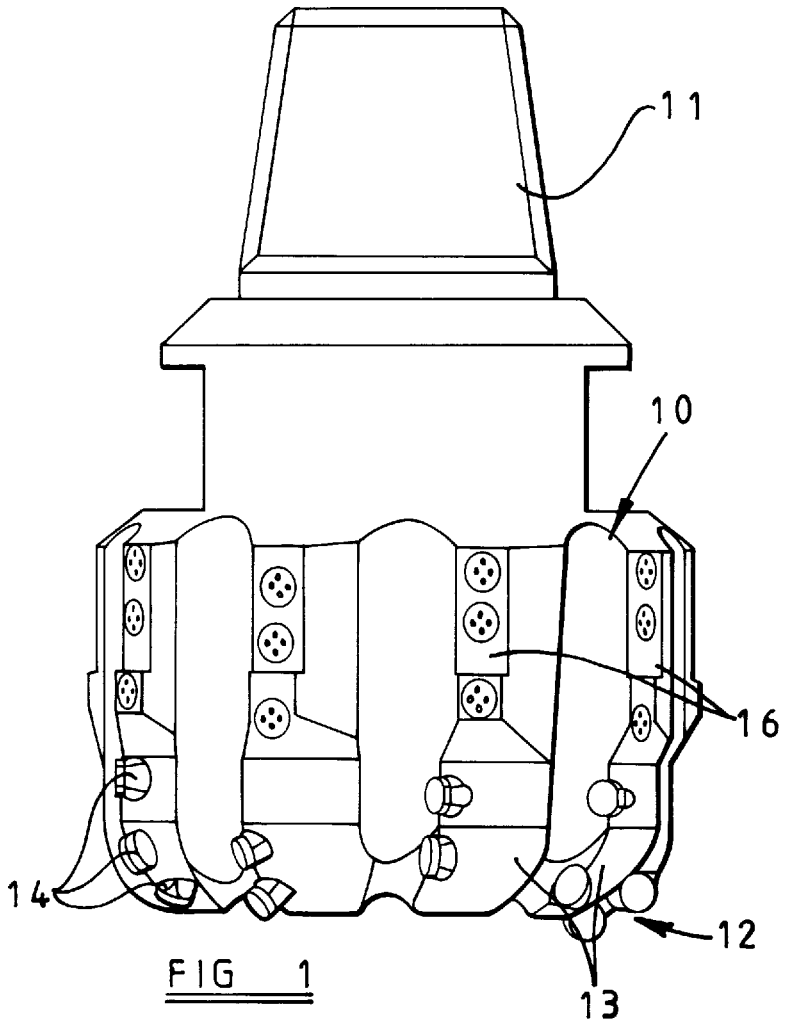
FIG. 1 is a side elevation of a typical drag-type drill bit in which preform elements according to the present invention may be used as cutting elements.
Figure 2:
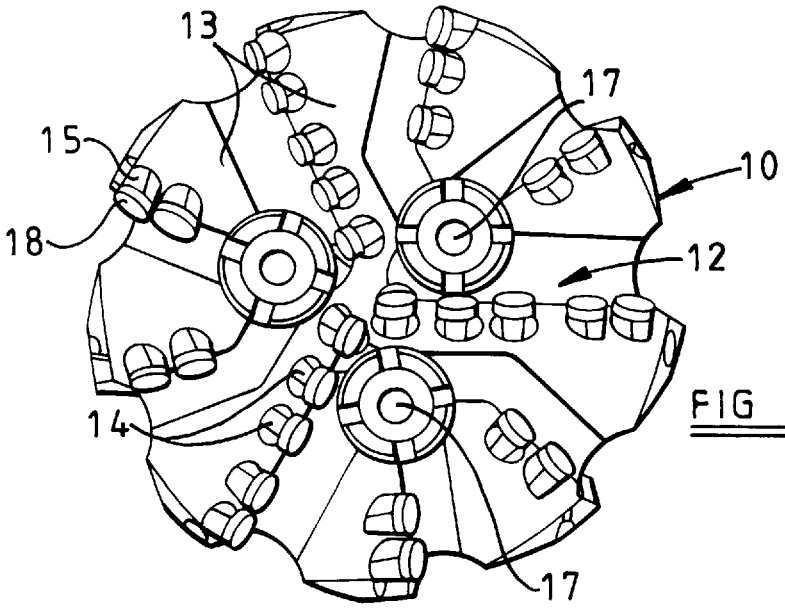
FIG. 2 is an end elevation of the drill bit shown in FIG. 1.

FIGS. 1 and 2 show a typical full bore drag bit of a kind to which cutting elements of the present invention are applicable. The bit body 10 is machined from steel and has a shank formed with an externally threaded tapered pin 11 at one end for connection to the drill string. The operative end face 12 of the bit body is formed with a number of blades 13 radiating from the central area of the bit, and the blades carry cutter assemblies 14 spaced apart along the length thereof. The bit has a gauge section including kickers 16 which contact the walls of the borehole to stabilise the bit in the borehole. A central passage (not shown) in the bit and shank delivers drilling fluid through nozzles 17 in the end face 12 in known manner.

Each cutter assembly 14 comprises a preform cutting element 18 mounted on a carrier 19 in the form of a post which is located in a socket in the bit body. Each preform cutting element is in the form of a circular tablet comprising a facing table 20 of superhard material, usually polycrystalline diamond, bonded to a substrate 21 which is normally of cemented tungsten carbide. The rear surface of the substrate is bonded, for example by LS bonding, to a suitably orientated surface on the post 19.

Figure 3:
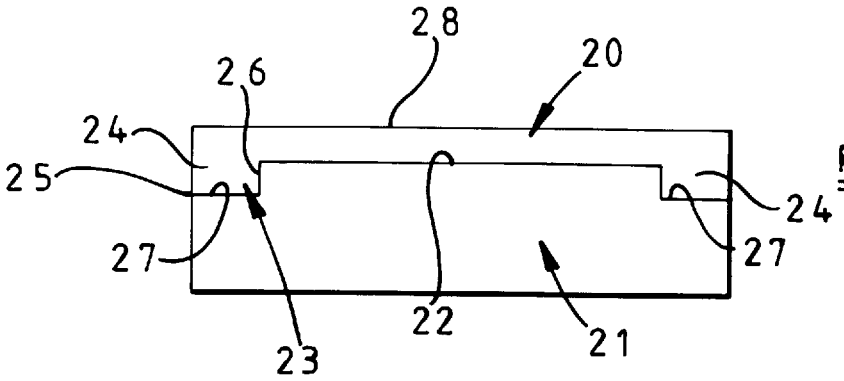
FIG. 3 is a cross-section, on an enlarged scale, of a preform cutting element in accordance with the invention.
Figure 4:
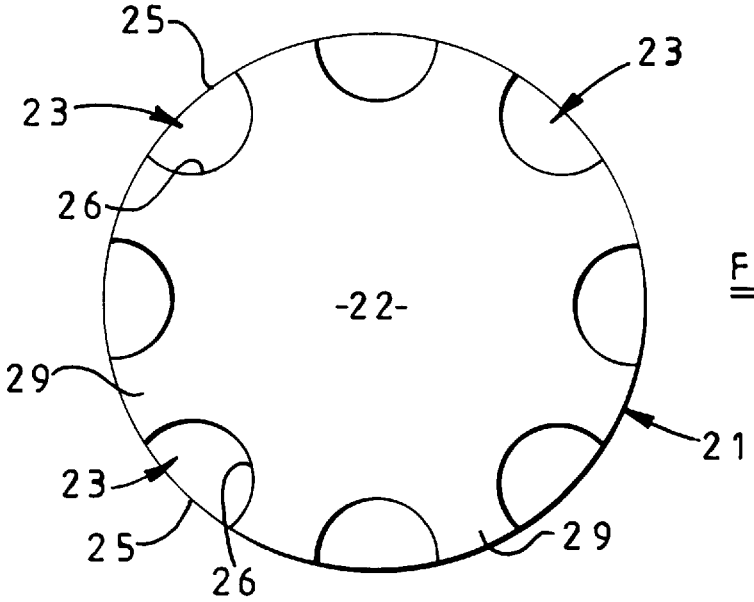
FIG. 4 is a plan view of the substrate of the cutting element of FIG. 3, the superhard facing table which would normally be bonded to the substrate having been removed to show the configuration of the upper face of the substrate.

One form of preform cutting element for a rotary drill bit, in accordance with the invention, is shown in FIGS. 3 and 4.

The front facing table 20 of polycrystalline diamond is bonded in a high pressure, high temperature press to the tungsten carbide substrate 21. The process for making such preform elements is well known and will not be described in detail. Although polycrystalline diamond and tungsten carbide are the most common materials used for such preforms, other suitable materials may also be used. For example, other suitable superhard materials for the facing table are cubic boron nitride and amorphous diamond-like carbon (ADLC).

FIG. 4 shows the front surface 22 of the substrate 21 with the facing table 20 removed to show the configuration of the front surface of the substrate. As may be seen from FIG. 4, the front surface 22 of the substrate is formed around its periphery with eight peripherally spaced recesses 23 into which extend corresponding projections 24 on the underside of the facing table. Each recess has an outer edge 25, which forms part of the periphery of the substrate 21, and a curved semi-circular inner edge surface 26. As may be seen from FIG. 4, the maximum length of each recess 23 along a radius of the facing table is less than the width of the recess in the peripheral direction.

The bottom surface 27 of each recess is substantially flat and is parallel to the front surface 28 of the facing table. The depth of each recess is approximately equal to the thickness of the facing table, and it will be seen from FIG. 3 that the combined thickness of the projections 24 and facing table 20 is less than half the overall thickness of the preform element as a whole.

Since the diamond projections 24 which fill the recesses 23 extend around a major part of the outer periphery of the facing table 20, they provide additional strength to that outer periphery in similar manner to the continuous peripheral rings employed in the aforementioned prior art. However, in the present case, unlike the prior art, the material of the substrate 21 extends outwardly between adjacent projections 23, into the regions indicated at 29 in FIG. 4, and thus provide a good mechanical interlock between the facing table and substrate in addition to the added peripheral strength. This mechanical interlock is thus provided within the depth of the equivalent peripheral ring and does not require projections extending beyond the depth of the peripheral ring, as in many of the prior art arrangements. Consequently, the overall depth of the facing table and projections is minimised, and does not therefore lead to reduction in strength of the substrate.

The projections 24 on the facing table 20 thus act in a different manner from the elongate radial and non-radial ribs shown in some prior art arrangements. The fact that the inner edge surfaces of the projections 24 are curved avoids stress concentrations within the substrate from which cracks may be initiated.

Figure 5:
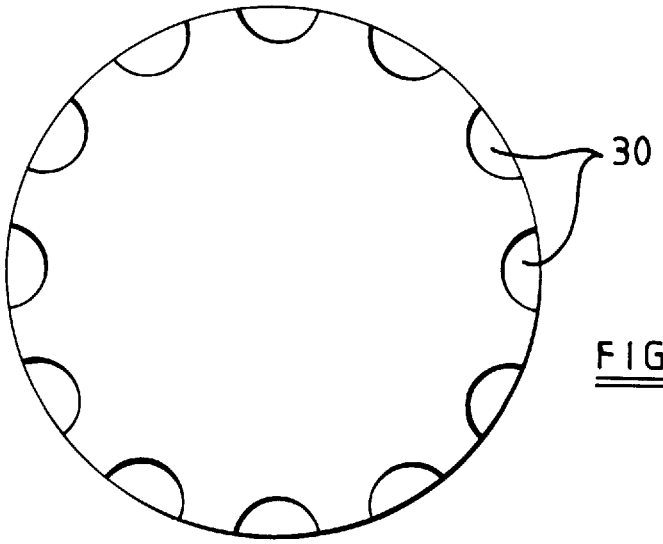
FIG. 5 is a similar view to FIG. 4 of an alternative embodiment.

FIG. 5 shown an alternative arrangement which is similar to the arrangement of FIGS. 3 and 4 except that in this case the recesses 30 are smaller and there are provided twelve such recesses equally spaced around the periphery of the substrate.

Although the recesses 23 and 30 are shown as being equally spaced, the invention includes arrangements where the recesses are non-equally spaced. Also, although in the preferred arrangement the bottom surfaces of the recesses are flat and parallel to the facing table, other shapes and orientations of the bottom surfaces are possible. The recesses may be of varying depths, around the periphery of the facing table, so that the corresponding projections on the facing table project into the substrate to different depths.

Figure 6:
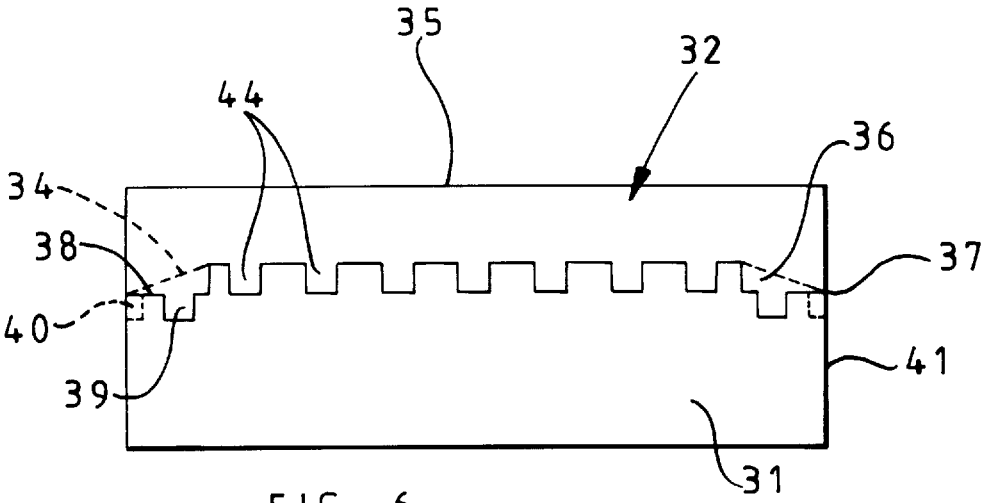
FIG. 6 is a cross-section on an enlarged scale of another form of preform cutting element in accordance with the invention.
Figure 7:
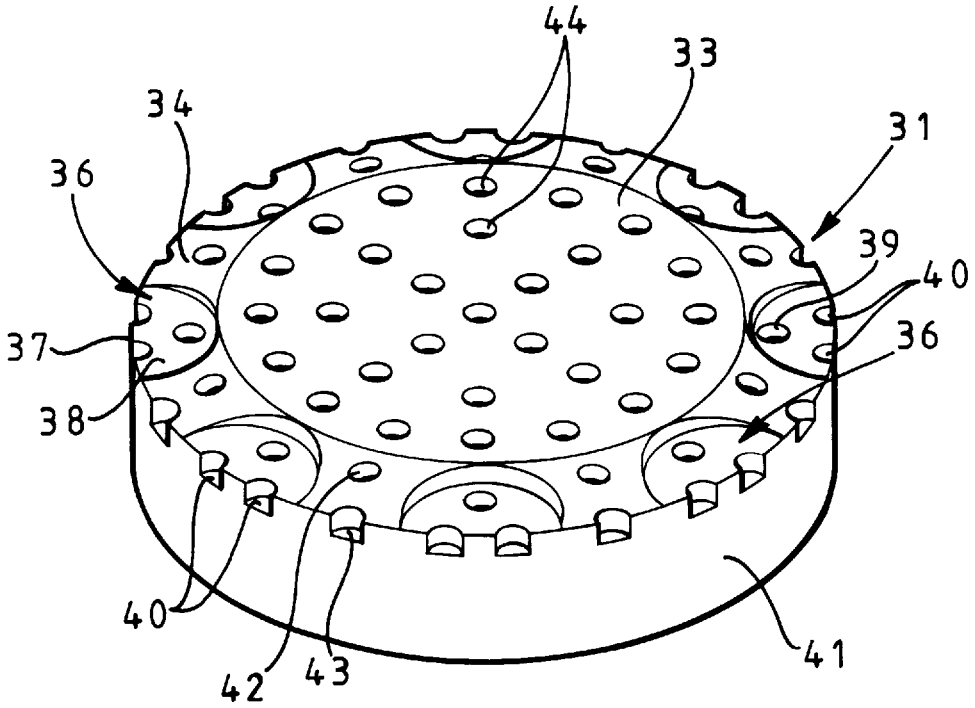
FIG. 7 is a diagrammatic perspective view of the substrate of the cutting element of FIG. 6, the superhard facing table having been removed to show the recesses in the upper surface of the substrate.

Another form of preform cutting element for a rotary drill bit, in accordance with the invention, is shown in FIGS. 6 and 7.

FIG. 7 shows the front surface of the substrate 31 with the polycrystalline diamond facing table 32 removed to show the configuration of the front surface of the substrate. As may be seen from FIG. 7, the substrate 31 is again generally in the form of a circular tablet. However, in this case the upper surface of the substrate, which provides the interface with the diamond facing table 32, comprises a flat circular central region 33 surrounded by an outer annular peripheral region 34 which is part-conical in form so that it is inclined away from the front surface 35 of the facing table as it extends outwardly.

The outer peripheral region 34 is formed with eight part-circular recesses 36 which are spaced equally apart around the periphery of the substrate. The outer edge 37 of each recess 36 is of zero depth and forms part of the peripheral edge of the substrate. The inner curved edge of each recess is tangential to the circular central region 33. The bottom surface 38 of each recess 36 is parallel to the front face 35 of the facing table 32, as best seen in FIG. 6, so that the recess increases in depth as it extends inwardly.

Three subsidiary recesses are formed in the bottom of each main recess 36. These comprise a recess 39 which is completely circular, and two recesses 40 which are semi-circular and intercept the outer periphery 41 of the substrate 31. Similar recesses 42 and 43 are also provided in the sloping surface 34 of the substrate between each adjacent pair of main recesses 36.

Similar circular subsidiary recesses 44 are also formed in an array over the central region 33 of the upper surface of the substrate.

The subsidiary recesses 39, 40, 42, 43 and 44 may be all of substantially the same depth or they may vary in depth in different locations over the surface of the substrate. For example, they may vary irregularly and randomly in depth across the surface of the substrate. The numbers, arrangement and shapes of the main recesses 36 and subsidiary recesses are by way of example only, and these recesses may differ in number, shape and arrangement from those shown in the drawing.

In one method of manufacture of the preform element, a solid substrate is first formed in the configuration of FIGS. 4, 5 or 6, or any other configuration in accordance with the invention. The pre-formed substrate is then placed in a high pressure, high temperature press in contact with a layer of diamond particles which fill all the recesses as well as providing a continuous layer across the face of the substrate. In some cases a transition layer of material of intermediate characteristics may be located between the diamond particles and the substrate, in known manner.

The assembly is then subjected to very high pressure and temperature in the press so that the diamond particles become bonded together, with diamond-to-diamond bonding, and also become bonded to the substrate to form the finished element as shown in FIGS. 3 and 6. Accordingly, all of the recesses of the substrate become completely filled with solid protrusions of diamond material which are integral with the facing table 20 or 32 and serve to lock the facing table to the substrate. Since the main recesses 23 and 36 are located at the periphery of the substrate, the diamond material which fills the recesses is exposed at the periphery of the element.

In an alternative method of construction the substrate which is placed in the press with the diamond layer may be of a diameter which is larger than that required for the finished element. In this case the recesses which are closest to the periphery of the substrate, such as the recesses 23, 30, 36, 40 and 43 may initially be complete circular recesses. After formation of the element in the press it is ground down around its periphery to the required final diameter, the grinding removing part of the diamond-filled outer recesses so as to expose the diamond at the outer periphery of the element, as shown in FIGS. 3 and 6.

It is found that the arrangement shown in the drawings, as well as providing good mechanical interlock and bonding between the diamond table and substrate, also provides a diamond table which is highly resistant to impact loads, particularly at the periphery of the preform element, and is resistant to spalling and delamination of the diamond table from the substrate.

Whereas the present invention has been described in particular relation to the drawings attached hereto, it should be understood that other and further modifications, apart from those shown or suggested herein, may be made within the scope and spirit of the present invention

What is claimed:

1. A preform element including a facing table of superhard material having a front face, a peripheral surface, and a rear surface bonded to the front surface of a substrate which is less hard than the superhard material, the front surface of the substrate being formed around its periphery with a plurality of spaced recesses into which extend projections of superhard material integrally formed on the rear surface of the facing table, the maximum depth of each recess being less than the thickness of the substrate so that each recess has a bottom surface, each recess having an outer part which lies adjacent the periphery of the substrate, and the maximum length of each recess, measured along a radius of the substrate, being no greater than twice the maximum width of said outer part of the recess.

2. A preform element according to claim 1, wherein the maximum length of each recess, measured along a radius of the substrate, is no greater than 1.5 times the maximum width of said outer part thereof.

3. A preform element according to claim 1, wherein the maximum length of each recess, measured along a radius of the substrate, is less than the maximum width of said outer part thereof.

4. A preform element according to claim 1, wherein the outer part of each recess lies on the outer periphery of the substrate.

5. A preform element according to claim 1, wherein at least one of said recesses has at least one subsidiary recess formed in the bottom surface thereof, into which subsidiary recess extends a protrusion of superhard material integrally formed on said projection of superhard material.

6. A preform element according to claim 1, wherein at least a part of each recess decreases in width as it extends inwardly away from the periphery of the substrate.

7. A preform element according to claim 6, wherein a part of each recess which is of reducing width is at least partly curvilinear.

8. A preform element according to claim 7, wherein said part of each recess which is of reducing width is part-circular.

9. A preform element according to claim 8, wherein said part of each recess which is of reducing width is substantially semi-circular.

10. A preform element according to claim 1, wherein the front surface of the substrate has a central region and an outer peripheral region which is generally inclined away from the front face of the facing table as it extends outwardly, said recesses being formed in the inclined outer peripheral region of the substrate.

11. A preform element according to claim 10, wherein each recess increases in depth as it extends inwardly towards the central region of the substrate.

12. A preform element according to claim 10, wherein each recess is of substantially zero depth at its outer extremity.

13. A preform element according to claim 10, wherein the inner extremity of each recess lies adjacent the central region of the substrate.

14. A preform element according to claim 1, wherein the front surface of the substrate is also formed with a plurality of spaced subsidiary recesses into which extend protrusions of superhard material integrally formed on the rear surface of the facing table.

15. A preform element according to claim 14, wherein at least some of the subsidiary recesses are circular in cross-section.

16. A preform element according to claim 14, wherein the depth of the subsidiary recesses varies irregularly across the surface of the substrate.

17. A preform element according to claim 14, wherein the subsidiary recesses are arranged in a regular pattern across the surface of the substrate.

18. A preform element according to claim 14, wherein the subsidiary recesses are spaced irregularly apart across the substrate.

19. A preform element according to claim 1, wherein the element is circular in configuration and of substantially constant thickness.

20. A preform element including a facing table of superhard material having a front face, a peripheral surface, and a rear surface bonded to the front surface of a substrate which is less hard than the superhard material, the front surface of the substrate being formed around its periphery with a plurality of spaced recesses into which extend projections of superhard material integrally formed on the rear surface of the facing table, each recess having an outer part which lies adjacent the periphery of the substrate, and an inner part which reduces in width as it extends inwardly away from the periphery of the substrate, said inner part being at least partly curvilinear.

21. A preform element including a facing table of superhard material having a front face, a peripheral surface, and a rear surface bonded to the front surface of a substrate which is less hard than the superhard material, the front surface of the substrate being formed around its periphery with a plurality of spaced recesses into which extend projections of superhard material integrally formed on the rear surface of the facing table, each recess having an outer part which lies adjacent the periphery of the substrate, and an inner part which reduces in width as it extends inwardly away from the periphery of the substrate, said inner part being substantially wholly curvilinear.

22. A preform element including a facing table of superhard material having a front face, a peripheral surface, and a rear surface bonded to the front surface of a substrate which is less hard than the superhard material, the front surface of the substrate being formed around its periphery with a plurality of spaced recesses into which extend projections of superhard material integrally formed on the rear surface of the facing table, each recess having a bottom surface and at least one subsidiary recess formed in the bottom surface thereof, a protrusion of superhard material integrally formed on the rear surface of the facing table extending into each subsidiary recess.

23. A preform element according to claim 22, wherein the subsidiary recess has an outer part which lies on the outer periphery of the substrate.

24. A preform element according to claim 23, wherein the subsidiary recess is generally of the same shape as the first said recess.

25. A preform element including a facing table of superhard material having a front face, a peripheral surface, and a rear surface bonded to the front surface of a substrate which is less hard than the superhard material, the front surface of the substrate being formed at its periphery with at least one recess into which extends a projection of superhard material integrally formed on the rear surface of the facing table, the maximum depth of each recess being less than the thickness of the substrate so that the recess has a bottom surface, the recess having an outer part which intersects part of the periphery of the substrate, and the maximum length of each recess, measured along a radius of the substrate, being no greater than twice the maximum width of said outer part of the recess at the periphery of the substrate.

26. A preform element according to claim 25, wherein the bottom surface of the recess is substantially flat.

27. A preform element according to claim 25, wherein the rear surface of the facing table is substantially flat except for said integrally formed projection which extends into the recess.

28. A preform element according to claim 25, wherein the maximum length of the recess, measured along a radius of the substrate, is no greater than 1.5 times the maximum width of the recess at the periphery of the substrate.

29. A preform element according to claim 25, wherein the maximum length of the recess, measured along a radius of the substrate, is less than the maximum width of the recess at the periphery of the substrate.

30. A preform element according to claim 25, wherein at least a part of the recess decreases in width as it extends inwardly away from the periphery of the substrate.

31. A preform element according to claim 30, wherein the part of the recess which is of reducing width is at least partly curvilinear.

32. A preform element according to claim 31, wherein the part of the recess which is of reducing width is part-circular.

* * * * *